US010800593B2

(12) United States Patent
Vincent

(10) Patent No.: US 10,800,593 B2
(45) Date of Patent: Oct. 13, 2020

(54) PIZZA BOX

(71) Applicant: AOTUS HOLDINGS PTY LTD, Highett, Victoria (AU)

(72) Inventor: Jack Edward Vincent, Highett (AU)

(73) Assignee: AOTUS HOLDINGS PTY LTD, Highett, Victoria (AU)

( * ) Notice: Subject to any disclaimer, the term of this patent is extended or adjusted under 35 U.S.C. 154(b) by 0 days.

(21) Appl. No.: 15/742,489

(22) PCT Filed: Jun. 21, 2016

(86) PCT No.: PCT/AU2016/050524

§ 371 (c)(1),
(2) Date: Jan. 5, 2018

(87) PCT Pub. No.: WO2016/205877

PCT Pub. Date: Dec. 29, 2016

(65) Prior Publication Data

US 2018/0201431 A1 Jul. 19, 2018

(30) Foreign Application Priority Data

Jun. 24, 2015 (AU) ..... 2015902430
Jul. 3, 2015 (AU) ..... 2015100884

(51) Int. Cl.
*B65D 81/36* (2006.01)
*A47G 23/06* (2006.01)
(Continued)

(52) U.S. Cl.
CPC ..... *B65D 81/363* (2013.01); *A41D 13/04* (2013.01); *A47G 23/0608* (2013.01);
(Continued)

(58) Field of Classification Search
CPC .... B65D 81/363; B65D 5/4212; B65D 85/36; B65D 2585/366; B65D 5/54;
(Continued)

(56) References Cited

U.S. PATENT DOCUMENTS 2,617,104 A 11/1952 Barager
2,704,625 A 3/1955 Huse
(Continued)

FOREIGN PATENT DOCUMENTS

AU 2001100635 A4 12/2001
CN 201647208 U 11/2010
(Continued)

OTHER PUBLICATIONS

"20 Cool Things You Can Make With a Pizza Box" | Bored Panda; retrieved from the Internet on Jan. 5, 2018 from <https://www.boredpanda.com/pizza-box-diy-ideas/>; 31 pages.
(Continued)

*Primary Examiner* — Christopher R Demeree
(74) *Attorney, Agent, or Firm* — Schwabe Williamson & Wyatt, PC

(57) ABSTRACT

The present invention relates to a pizza box comprising a lid section and a tray section, wherein the lid section comprises a recess that accommodates the neck of a user, or wherein the lid section comprises a tear line defining a removable section. The present invention alleviates the problem of dropping pizza and/or pizza toppings on the consumer, and provides additional utility.

18 Claims, 2 Drawing Sheets

(51) Int. Cl.

| | |
|---|---|
| ***B65D 5/42*** | (2006.01) |
| ***A41D 13/04*** | (2006.01) |
| ***B65D 85/36*** | (2006.01) |
| *A41B 13/10* | (2006.01) |

(52) U.S. Cl.
CPC ..... *B65D 5/4208* (2013.01); *B65D 5/4212* (2013.01); *B65D 81/368* (2013.01); *B65D 85/36* (2013.01); *A41B 13/10* (2013.01); *A41D 2400/52* (2013.01); *B65D 2585/366* (2013.01)

(58) Field of Classification Search
CPC .. B65D 75/5833; B65D 77/245; A41D 13/04; A47G 23/0608; A47G 21/001; A47G 2023/0675; A47G 23/06; A41B 13/10; A47B 23/002
USPC ..... 229/103, 902, 904, 906, 101.1, 939, 229/117.31, 123.3, 200, 202, 210, 233, 229/234, 235, 236, 237, 242, 243; 224/270, 275, 906; 2/49.1, 46; 426/115; D2/860, 861; 108/43
See application file for complete search history.

(56) References Cited

U.S. PATENT DOCUMENTS

| | | | | | |
|---|---|---|---|---|---|
| 4,946,094 | A * | 8/1990 | Stang | A41B 13/103 224/270 |
| 4,971,242 | A | 11/1990 | LaNicca | |
| 5,632,379 | A | 5/1997 | Frost | |
| 5,701,605 | A | 12/1997 | Bowen | |
| 6,095,058 | A * | 8/2000 | Earnhart | A47B 23/002 108/43 |
| 6,158,052 | A * | 12/2000 | Smith | A41B 13/10 2/46 |
| D448,143 | S * | 9/2001 | Shealey | D2/860 |
| 6,789,265 | B1 * | 9/2004 | Vonrinteln | A41B 13/103 2/48 |
| 6,826,780 | B1 * | 12/2004 | Romesburg | A41B 13/103 2/48 |
| 7,004,377 | B2 * | 2/2006 | Metcalf | A47G 21/001 229/101.1 |
| 7,178,170 | B2 * | 2/2007 | Thompson | A41B 13/103 2/48 |
| 2003/0209592 | A1 | 11/2003 | Holden | |
| 2010/0044422 | A1 | 2/2010 | Shamsnobari | |

FOREIGN PATENT DOCUMENTS

| | | | |
|---|---|---|---|
| DE | 102009043343 | A1 | 12/2010 |
| FR | 2900556 | A1 | 11/2007 |

OTHER PUBLICATIONS

Office Action issued in Chinese Patent Application No. 201680037086.2 dated Feb. 19, 2019; 7 pages (no English translation available).
Extended European Search Report in European Patent Application No. 16813385.8 dated Feb. 21, 2019; 9 pages.

* cited by examiner

PIZZA BOX

CROSS-REFERENCE TO RELATED APPLICATION

The present application is a national phase entry under 35 U.S.C. § 371 of International Application No. PCT/AU2016/050524, filed Jun. 21, 2016, entitled "PIZZA BOX" which designates the United States of America, which claims priority to AU Application No. 2015902430, filed Jun. 24, 2015 and AU Application No. 2015100884, filed Jul. 3, 2015, the entire disclosures of which are hereby incorporated by reference in their entireties and for all purposes.

FIELD OF THE INVENTION

The present invention relates to the field of fast food packaging. More particularly, the invention relates to a pizza box.

BACKGROUND TO THE INVENTION

Any reference to background art herein is not to be construed as an admission that such art constitutes common general knowledge in Australia or elsewhere.

Pizza boxes are well known and are used to transport pizza from a restaurant to a destination where the pizza is to be consumed. As such, pizza boxes are designed to facilitate transport, and can be stacked on top of one another to allow for multiple pizza boxes to be transported.

Pizza can be greasy due to the fats and oils used in their cooking. In this regard, it is important that a pizza box alleviates the problem of fats and oils being deposited on clothes, car seats and the like. A pizza box alleviates this problem by providing an additional layer that absorbs the fats and oils so that they are not transferred to clothes and/or car seats.

Once a pizza has been transported, the pizza box typically has limited use and is generally discarded. Typically, the consumer uses crockery and tableware in the consumption of pizza to alleviate the problem of making a mess by dropping pizza and/or pizza toppings on their clothes. It will be appreciated that crockery and tableware may not always be available when consuming a pizza, and in such a situation there is an increased risk of dropping pizza and/or pizza toppings on a consumer's clothes. Additionally, the pizza or pizza toppings may also be dropped on the floor where they may cause damage to the floor surface or create a slipping hazard.

It would be useful to reduce the chance of dropping pizza toppings and/or pizza on a consumer's clothes or the floor, and alleviate the need for crockery and tableware. It would be useful to provide a pizza box that provides additional utility. It would also be useful to provide a pizza box that is able to address some of the problems associated with the prior art pizza boxes discussed above.

SUMMARY OF THE INVENTION

In a first aspect, although it need not be the only or indeed the broadest form, the invention resides in a pizza box comprising a lid section connected to a tray section; wherein the lid section comprises a recess that accommodates the neck of a user, or wherein the lid section comprises a tear line defining a removable section, which, when removed, forms a recess that accommodates the neck of a user.

In an embodiment, the pizza box further comprises at least one visual cue.

In one embodiment, the at least one visual cue provides directions to the user to remove the removable section and to use the lid section as a bib.

In an embodiment, the at least one visual cue comprises at least one of text, diagrams and pictures.

In a further embodiment, the removable section is continuous with an edge portion of the lid section.

In another embodiment, the removable section is entirely located within the body of the lid section.

In one embodiment, the lid section comprises a plurality of removable sections.

In certain embodiments, the tear line comprises perforations formed into the lid section.

In one embodiment, the tear line completely surrounds the removable section.

In another embodiment, the tear line partially surrounds the removable section.

In a second aspect, the invention resides in a method of using a pizza box comprising the steps of:

a. providing a pizza box that comprises a lid section connected to a tray section; wherein the lid section comprises a recess that accommodates the neck of a user, or wherein the lid section comprises a tear line defining a removable section, which when removed forms a recess that accommodates the neck of a user,
b. optionally, removing the removable section from the lid section; and
c. locating the neck of the user within the recess of the lid section.

In an embodiment, the pizza box further comprises at least one visual cue.

In one embodiment, the at least one visual cue provides directions to the user to remove the removable section and to use the lid section as a bib.

In an embodiment, the at least one visual cue comprises text, diagrams and/or pictures.

In one embodiment, the removable section is continuous with an edge of the lid section.

In another embodiment, the removable section is located within the lid section.

In a further embodiment, the pizza box comprises a plurality of removable sections.

In one embodiment, the tear line completely surrounds the removable section.

In another embodiment, the tear line partially surrounds the removable section.

The pizza box of the second aspect may be as described in any one or more embodiments of the first aspect.

The various features and embodiments of the present invention referred to in the individual sections above apply, as appropriate, to other sections, mutatis mutandis. Consequently features specified in one section may be combined with features specified in other sections as appropriate.

Further features and advantages of the present invention will become apparent from the following detailed description.

BRIEF DESCRIPTION OF THE DRAWINGS

To assist in understanding the invention and to enable a person skilled in the art to put the invention into practical effect, preferred embodiments of the invention will be described by way of example only with reference to the accompanying drawings, in which.

DETAILED DESCRIPTION OF THE INVENTION

Figure 1:
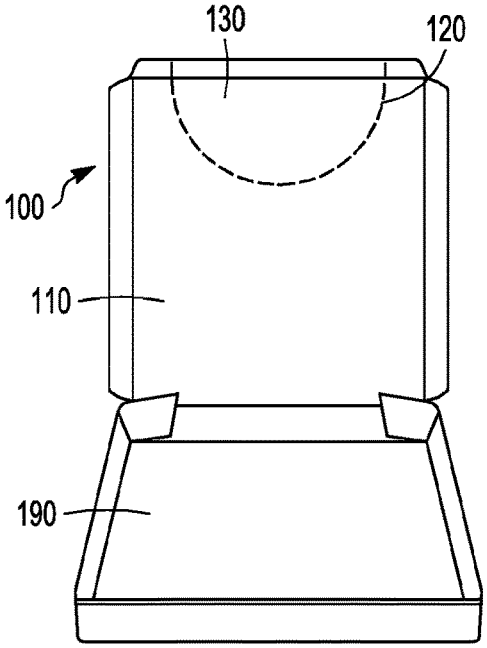
FIG. 1 shows one embodiment of a pizza box.

Embodiments of the present invention reside primarily in a pizza box. Accordingly, the method steps and pizza box have been illustrated in concise schematic form in the drawings, showing only those specific details that are necessary for understanding the embodiments of the present invention, but so as not to obscure the disclosure with excessive detail that will be readily apparent to those of ordinary skill in the art having the benefit of the present description.

In this specification, adjectives such as first and second, at least one, and the like may be used solely to distinguish one element or action from another element or action without necessarily requiring or implying any actual such relationship or order. Words such as "comprises" or "includes" are intended to define a non-exclusive inclusion, such that a method or pizza box that comprises a list of elements does not include only those elements but may include other elements not expressly listed, including elements that are inherent to such a method or pizza box.

The term 'pizza box', as used herein, refers to a device that is used to transport pizza. The term 'pizza box' is well known in the art and this term encompasses all such pizza boxes known in the art.

Referring to FIGS. 1 to 4 there is shown one embodiment of a pizza box 100. The pizza box 100 comprises a lid section 110 that is connected to a tray section 190. The lid section 110 comprises a tear line 120 which defines a removable section 130. In one embodiment, the lid section 110 and the tray section 190 are integrally formed. Pizza boxes typically have the lid section 110 integrally formed with the tray section 190, however, it will be appreciated that the lid section 110 and the tray section 190 may be connected to each other in any manner such as by removable tags or interconnecting/overlapping retaining elements.

Figure 2:
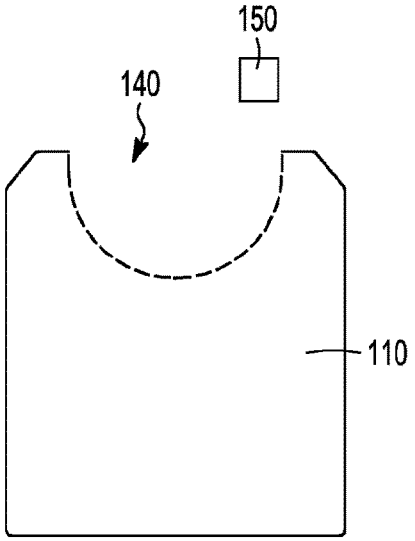
FIG. 2 shows an expanded view of the lid section of the pizza box of FIG. 1 with the removable section removed.
Figure 3:
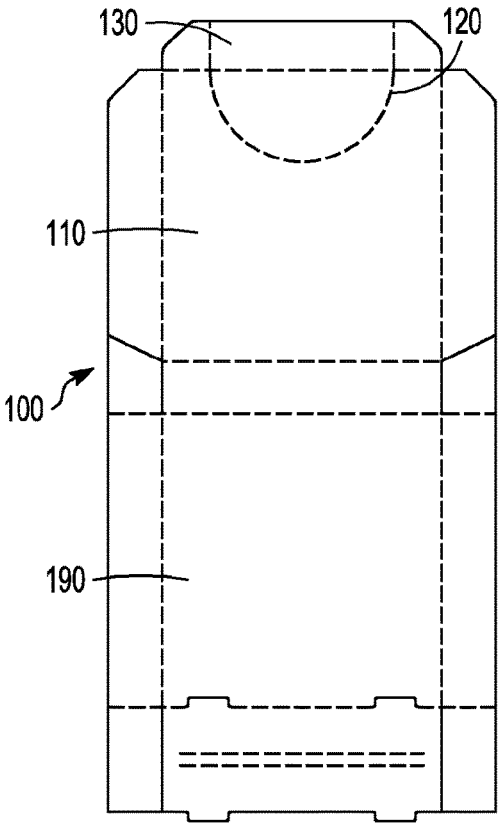
FIG. 3 shows a flattened form of the pizza box of FIG. 1.
Figure 4:
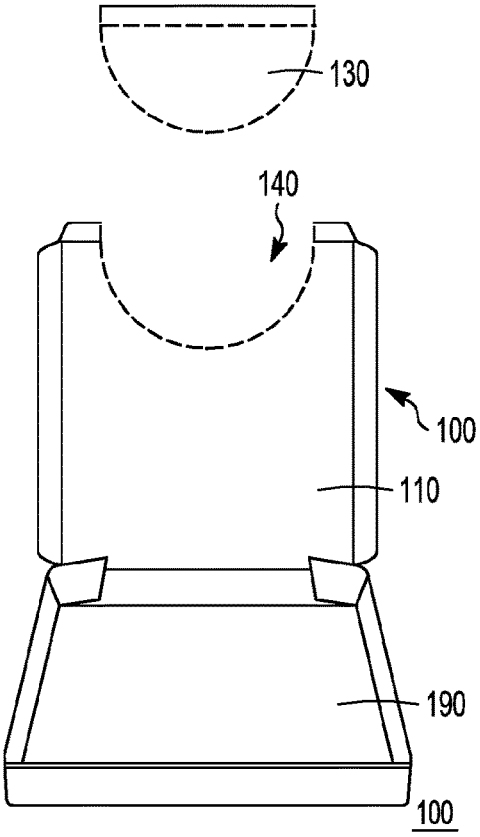
FIG. 4 shows the pizza box of FIG. 1 with the removable section removed.

When the removable section 130 is removed from the lid section 110 it forms a recess 140 (shown in FIGS. 2 and 4). The recess 140 accommodates the neck of a consumer so that they can use the pizza box 100 as a form of protection from dropping pizza toppings and/or pizza onto the floor or onto their clothes. As such, the lid section 110 with the removable section 130 removed can be used in a fashion similar to a traditional bib to keep the clothes of a consumer clean whilst eating. A further advantage of the abovementioned pizza box 100 is that, when in use, the tray section 190 can be used in a similar fashion as a plate and alleviates the need for crockery, and this provides additional utility.

The removable section 130 is not restricted to any particular shape, size, dimension or form. It will be appreciated that the removable section 130 can have multiple removable sections placed within each other. In this regard, a first larger removable section defined by a tear line can have a smaller second removable section defined by a second corresponding tear line located within the larger first removable section, and a third even smaller removable section defined by another tear line can be located within the second removable section. It will be appreciated that a plurality of differently sized removable sections defined by different tear lines can be formed in the pizza box 100. The different sized removable sections and their associated tear lines can be used to accommodate necks of different sizes. In this regard, it will be appreciated that the neck size of an adult is generally larger than the neck size of a child or infant. This configuration provides the consumer with the option of determining the size of the recess to be in accordance with the size of the neck that needs to be accommodated. The removable section 130 may also be a pull away neckpiece. In one embodiment, the pizza box 100 comprises a plurality of removable sections. In such an embodiment, the pizza box comprises a plurality of tear lines.

In another embodiment, the tear line 120 comprises an area of structural weakness so that the tear line 120 facilitates the removal of the removable section 130. As such, the tear line 120 may comprise perforations, cuts and/or punctures. The tear line 120 can be formed with a perforating cutter, needle punch or laser cutter. In this regard, it will be appreciated that the above list is not an exhaustive list, but is merely indicative of a number of methods by which the tear line 120 can be formed. These methods and techniques will be apparent to the person skilled in the art. The tear line 120 is not restricted to any particular shape, size, dimension or form. It will be appreciated that the tear line 120 has a reciprocal shape, dimension and size to the associated removable section 130. In one embodiment, the tear line is continuous with an edge of the lid section.

In one embodiment, the tear line comprises an area of structural weakness that only partially surrounds the removable section 130. In this embodiment, a major part of the tear line can be broken so that part of the removable section and the lid section is separated. In this regard, there is still a section of the removable section that is integrally formed with the lid section. As such, the removable section can be folded so that it lies substantially flat with the lid section and still forms a recess to accommodate the neck of a user.

The pizza box 100 may further include instructions or gestures that depict or communicate, to the consumer, how the pizza box 100 should be used and/or operated. In one embodiment, the pizza box 100 further includes at least one visual cue 150. The visual cue 150 may include any manner of visual instruction, such as diagrams, text, pictures or flow diagrams, of how to use the pizza box 100. The visual cues 150 may be formed on the pizza box 100. Alternatively, the visual cues 150 can be formed separately from the pizza box 100 and be removably attached to the pizza box 100 (shown in FIGS. 2 and 6). In one embodiment, the pizza box comprises at least one visual cue.

It will be appreciated that the at least one visual cue 150 can be placed anywhere on the pizza box 100. For instance, the at least one visual cue 150 can be printed on either the interior or exterior of the pizza box 100. Alternatively, the at least one visual cue 150 may be removably attached to the interior or exterior of the pizza box 100. Alternatively, the at least one visual cue 150 may accompany the pizza box 100 and is not required to be secured or attached to the pizza box 100. Alternatively, the at least one visual cue 150 can be formed in the lid section 110 of the pizza box 100. In this embodiment, the at least one visual cue 150 can be accompanied by a perforated edge to facilitate removal of the at least one visual cue 150.

It will be appreciated that when the consumer is eating the pizza they will be viewing the pizza box 100 and so it may be used for displaying advertising. For example, the interior of the lid section 110 may be furnished with advertising material or logos. In this regard, as the consumer uses the pizza box 100 in a bib-like manner, the advertising material will face outwardly. The advertising material may comprise, amongst other things, OR codes, website addresses, pictures, logos and slogans.

The removable section 130 has been described as being completely removed from the edge of the lid section 110. However, the removable section 130 can also form an aperture in the lid section 110. In this regard, the removable section 130 may not necessarily be located at the edge of the lid section 110, but instead may be located within the lid section 110. In this embodiment, the removal of the removable section 130 results in an aperture being formed in the lid section 110. The consumer can completely place their head through the aperture such that the lid section 110 completely encompasses their neck. In such an embodiment, the removable section 130 may leave edges which have incisions formed therein such that this part of the material will part to allow the user's head to be pushed through but will, to an extent, retake its shape to fit more snugly around the user's neck than might otherwise occur.

It will be appreciated by the person skilled in the art that the present pizza box can have the removable section removed. In this embodiment, the pizza box can have a recess pre-formed in the lid section (shown in FIG. 4). As such the pizza box comprises a lid section connected to a tray section; wherein the lid section comprises a recess that accommodates the neck of a user. Further to this, the pizza box can also have an aperture pre-formed in the lid section. As such, a pizza box comprising a lid section connected to a tray section; wherein the lid section comprises an aperture that accommodates the neck of a user. In these embodiments, the pizza box can be used in a bib-like fashion immediately and does not require the consumer to remove a removable section. It will be appreciated by the person skilled in the art that this pre-formed recess or pre-formed aperture is different to the small hole used in prior art pizza boxes for releasing hot gas so that the contained pizza does not become soggy. The recess or aperture is sufficiently sized and shaped to fit the neck of a consumer. In one embodiment, the recess is continuous with an edge of the lid section. In another embodiment, the recess encompasses an edge portion of the lid section. Furthermore, the recess or aperture will be sized to accommodate a neck of the consumer. In these embodiments, the person skilled in the art will appreciate that the advantages discussed herein in relation to the lid comprising the removable section are equally applicable. It will be appreciated that these pizza boxes can be accompanied by the at least one visual cue. The visual cue may include any manner of visual instruction, such as diagrams, text, pictures or flow diagrams, of how to use the pizza box.

Figure 5:
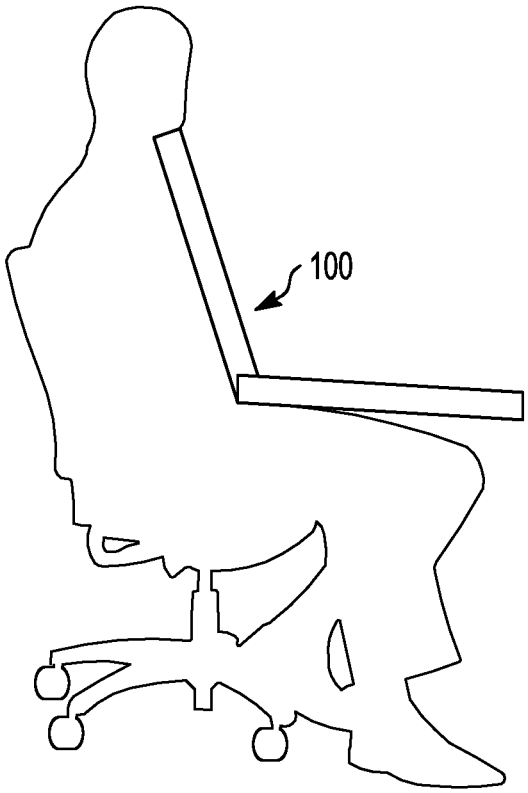
FIG. 5 shows a side view of a consumer using the pizza box of FIG. 1.
Figure 6:
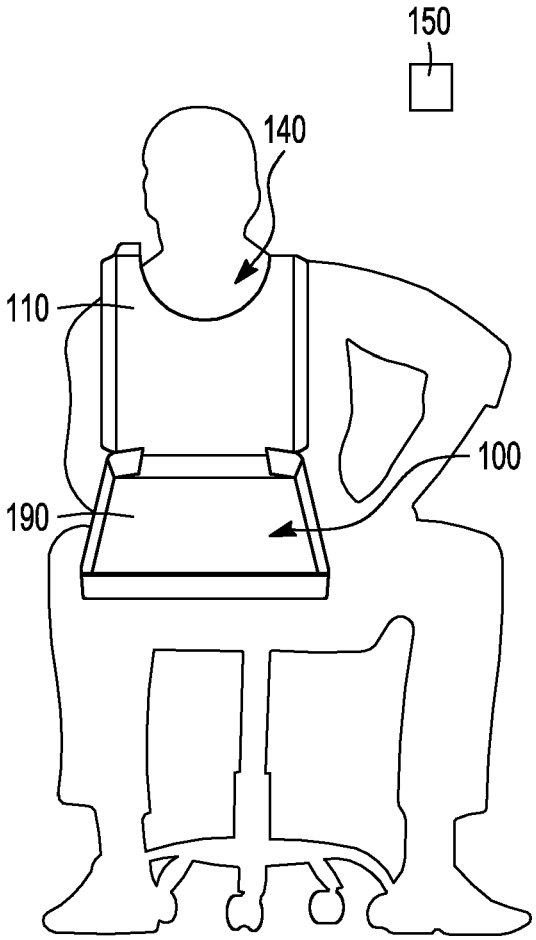
FIG. 6 shows a front view of a consumer using the pizza box of FIG. 1

Referring to FIG. 5 there is shown a side view of a consumer using one embodiment of the pizza box 100, and referring to FIG. 6 there is shown a front view of a consumer using a similar embodiment of the pizza box 100. The pizza box 100 is substantially as described hereinabove.

Once the removable section 130 has been removed from the lid section 110, the consumer can use the pizza box 100 in a manner similar to a bib. The pizza box 100 can either sit conveniently on the consumers lap (as shown in FIGS. 5 and 6), or sit on another surface, such as a table or the like. It should be clear that the pizza box 100 used in this orientation alleviates the problem of pizza toppings or pizza falling onto the clothes of the consumer or the floor. Eating the contents of the pizza box 100 in this manner creates a protective garment to alleviate the risk of spilling the contents of the pizza box on the consumer. It should also be clear that the pizza box used in this orientation alleviates the need for crockery and tableware.

Some prior art pizza boxes comprise components which help alleviate the problem of grease and oil penetrating through the pizza box. In this regard, it will be appreciated by those skilled in the art that pizza box 100 may further comprise waxes and additional components which prevent fats and oils from soaking through the pizza box.

It should be clear that the present pizza box 100 facilitates transport, protection and maintenance of a suitable temperature of a pizza when the removable section 130 is connected to the lid section 110. Further to this, the present pizza box 100 also provides additional utility when the removable section 130 has been removed from the lid section 110 and serves to provide additional protection to the consumer by allowing them to use the tray section 190 and lid section 110 in a similar fashion to a bib.

The above description of various embodiments of the present invention is provided for purposes of description to one of ordinary skill in the related art. It is not intended to be exhaustive or to limit the invention to a single disclosed embodiment. As mentioned above, numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. Accordingly, this invention is intended to embrace all alternatives, modifications and variations of the present invention that have been discussed herein, and other embodiments that fall within the spirit and scope of the above described invention.

The invention claimed is:

1. A pizza box comprising a lid section connected to a tray section; wherein the lid section comprises a tear line defining a single arcuate removable section disposed on a free end thereof, which when removed forms an arcuate recess that accommodates a neck of a user.

2. The pizza box of claim 1, wherein the pizza box further comprises at least one visual cue.

3. The pizza box of claim 2, wherein the at least one visual cue provides directions to the user to remove the single arcuate removable section and to use the lid section as a bib.

4. The pizza box of claim 2, wherein the at least one visual cue comprises text, diagrams and/or pictures.

5. The pizza box of claim 1, wherein the tear line is continuous with the free end.

6. The pizza box of claim 1, wherein the tear line completely surrounds the single arcuate removable section.

7. The pizza box of claim 1, wherein the tear line partially surrounds the single arcuate removable section.

8. The pizza box of claim 1, wherein the single arcuate removable section is a semicircular removable section.

9. A method of using a pizza box comprising the steps of:

a. providing a pizza box that comprises a lid section connected to a tray section; wherein the lid section comprises a tear line defining a single arcuate removable section disposed on a free end thereof, which when removed forms an arcuate recess that accommodates a neck of a user;

b. removing the single arcuate removable section from the lid section; and c. locating the neck of the user within the arcuate recess of the lid section.

10. The method of claim 9, wherein the pizza box further comprises at least one visual cue.

11. The method of claim 10, wherein the at least one visual cue provides directions to the user to remove the single arcuate removable section and to use the lid section as a bib.

12. The method of claim 10, wherein the at least one visual cue comprises text, diagrams and/or pictures.

13. The method of claim 9, wherein the tear line is continuous with the free end.

14. The method of claim 9, wherein the tear line completely surrounds the single arcuate removable section.

15. The method of claim 9, wherein the tear line partially surrounds the single arcuate removable section.

16. The method of claim 9, wherein the single arcuate removable section is a semicircular removable section.

17. A pizza box comprising a lid section connected to a tray section; wherein the lid section comprises a single arcuate removable section disposed on a free end of the lid section, the single arcuate removable section being defined by a tear line; wherein, when the single arcuate removable section is removed, an arcuate recess that accommodates a neck of a user is formed in the lid section.

18. The pizza box of claim 17, wherein the single arcuate removable section is a semicircular removable section.

* * * * *